US007624615B2

(12) United States Patent
Nieschulz

(10) Patent No.: US 7,624,615 B2
(45) Date of Patent: Dec. 1, 2009

(54) WEDGE ACTIVATED ROTATING FILLER CAM

(75) Inventor: Daniel F. Nieschulz, Macomb, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 440 days.

(21) Appl. No.: 11/553,524

(22) Filed: Oct. 27, 2006

(65) Prior Publication Data

US 2008/0098792 A1 May 1, 2008

(51) Int. Cl.
*B21D 5/04* (2006.01)

(52) U.S. Cl. ..... 72/452.9; 72/452.4

(58) Field of Classification Search ..... 72/459.9, 72/452.4, 452.9
See application file for complete search history.

(56) References Cited

U.S. PATENT DOCUMENTS 4,347,727 A * 9/1982 Galiger ..... 72/389.4
5,347,838 A * 9/1994 Matsuoka ..... 72/313
6,038,908 A 3/2000 Kinoshita
6,196,041 B1 * 3/2001 Codatto ..... 72/323
6,523,386 B2 2/2003 Matsuoka
6,792,785 B2 9/2004 Kinoshita
7,013,783 B2 3/2006 Matsuoka
7,243,524 B2 7/2007 Kinoshita
2002/0124620 A1 * 9/2002 Matsuoka ..... 72/312
2005/0115296 A1 * 6/2005 Sato ..... 72/354.8
2005/0115301 A1 * 6/2005 Kinoshita ..... 72/381

OTHER PUBLICATIONS

Presentation Of The "Swing Die" patented by Your Business Co., Ltd., Tokyo Japan, 54 pages.

* cited by examiner

*Primary Examiner*—Dana Ross
*Assistant Examiner*—Mohammad Yusuf
(74) *Attorney, Agent, or Firm*—Ralph E. Smith

(57) ABSTRACT

A rotating filler cam system including a lower die having a plurality of filler cams rotatably connected to thereto. A plurality of wedge assemblies are connected to a drive shaft, wherein upon actuation of the drive shaft, the wedge assemblies are driven to contact the filler cams and rotate the filler cams from a non-flanging to a flanging position.

16 Claims, 9 Drawing Sheets

WEDGE ACTIVATED ROTATING FILLER CAM

FIELD OF THE INVENTION

The present invention relates to rotating filler cam.

BACKGROUND OF THE INVENTION

To form a flange on a sheet metal panel using a die, two cams are generally used. The first cam is a filler cam or anvil and the other cam is the form cam that forms or flanges the sheet metal around the filler cam. The filler cam is retracted after the forming process so the formed or flanged panel can be removed. The process may then be started over.

There are several types of cams that perform the above function. Of the types of cams that are available, a rotary filler cam is regarded as the best because these types of cams are able to fit into tight conditions. Rotary filler cams work in conjunction with an aerial form cam to form or flange the sheet metal panel. These types of cams, however, are expensive and are generally manufactured overseas.

Further, the use of an aerial form cam in conjunction with the rotary filler cam has drawbacks in that the aerial form cam is mounted to the upper die and can interfere with automation curves during panel transfers in the press, which can lead to process and styling changes. Moreover, aerial form cams are heavy and can add unbalanced weight to the upper die and press. This may present a problem when separating the die during construction, maintenance, and repair.

SUMMARY OF THE INVENTION

The present teachings provide a rotating filler cam system including a lower die having a plurality of filler cams rotatably connected to thereto. A plurality of wedge assemblies are connected to a drive shaft, wherein upon actuation of the drive shaft, the wedge assemblies are driven to contact the filler cams and rotate the filler cams from a non-flanging to a flanging position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present teachings will become more fully understood from the detailed description and the accompanying drawings, wherein.

DETAILED DESCRIPTION OF THE PREFERRED EMBODIMENTS

The following description of the present teachings is merely exemplary in nature and is in no way intended to limit the present teachings, their application, or uses.

Figure 5A:
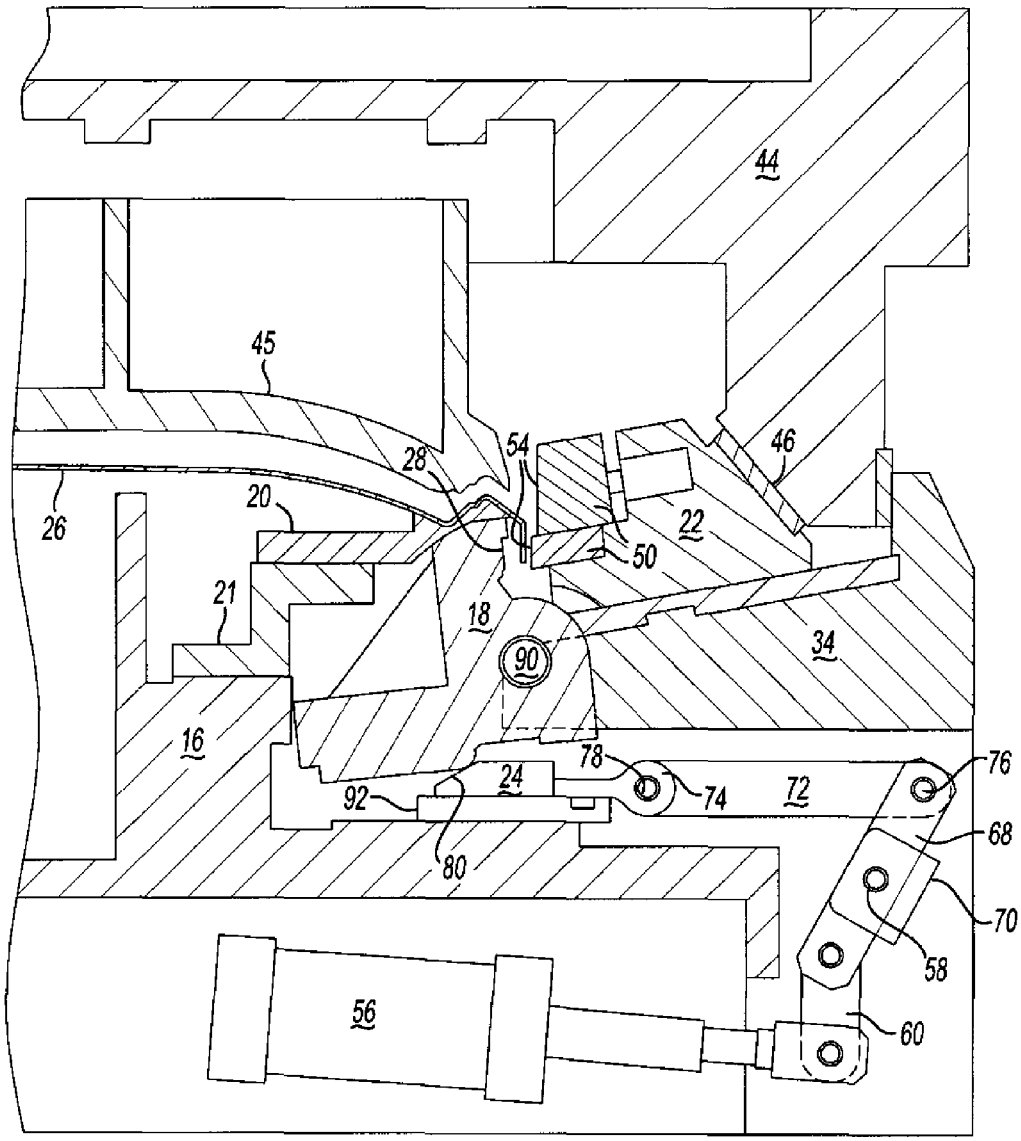
FIGS. 5A and 5B are cross-sectional views depicting actuation of the rotating filler cam system according to the present teachings.

A rotating filler cam system according to the present teachings will now be described referring to FIGS. 1-5B. As illustrated in the figures, the rotating filler cam system 10 generally includes a cam assembly 12 that is actuated by a wedge actuation assembly 14. Rotating filler cam system 10 is disposed on a mounting structure 16 that is generally known in the art as a lower die or shoe (FIG. 5A).

The cam assembly 12 generally includes a plurality of rotating filler cams 18; a plurality of caps 20*a*, 20*b*, and 20*c*; and at least one forming cam 22. The rotating filler cams 18 are actuated by wedges 24 that are driven by the wedge actuation assembly 14. Although a rotating filler cam system 10 having plurality of rotating filler cams 18 and caps 20 is described, the present teachings are equally applicable to a rotating filler cam system 10 that includes a single rotating filler cam 18 and a single cap 20. Further, although only a single rotating filler cam 18 can be seen in the figures, it should be understood that each cap 20*a*, 20*b*, and 20*c* has a corresponding rotating filler cam 18 that works in conjunction therewith.

Figure 5B:
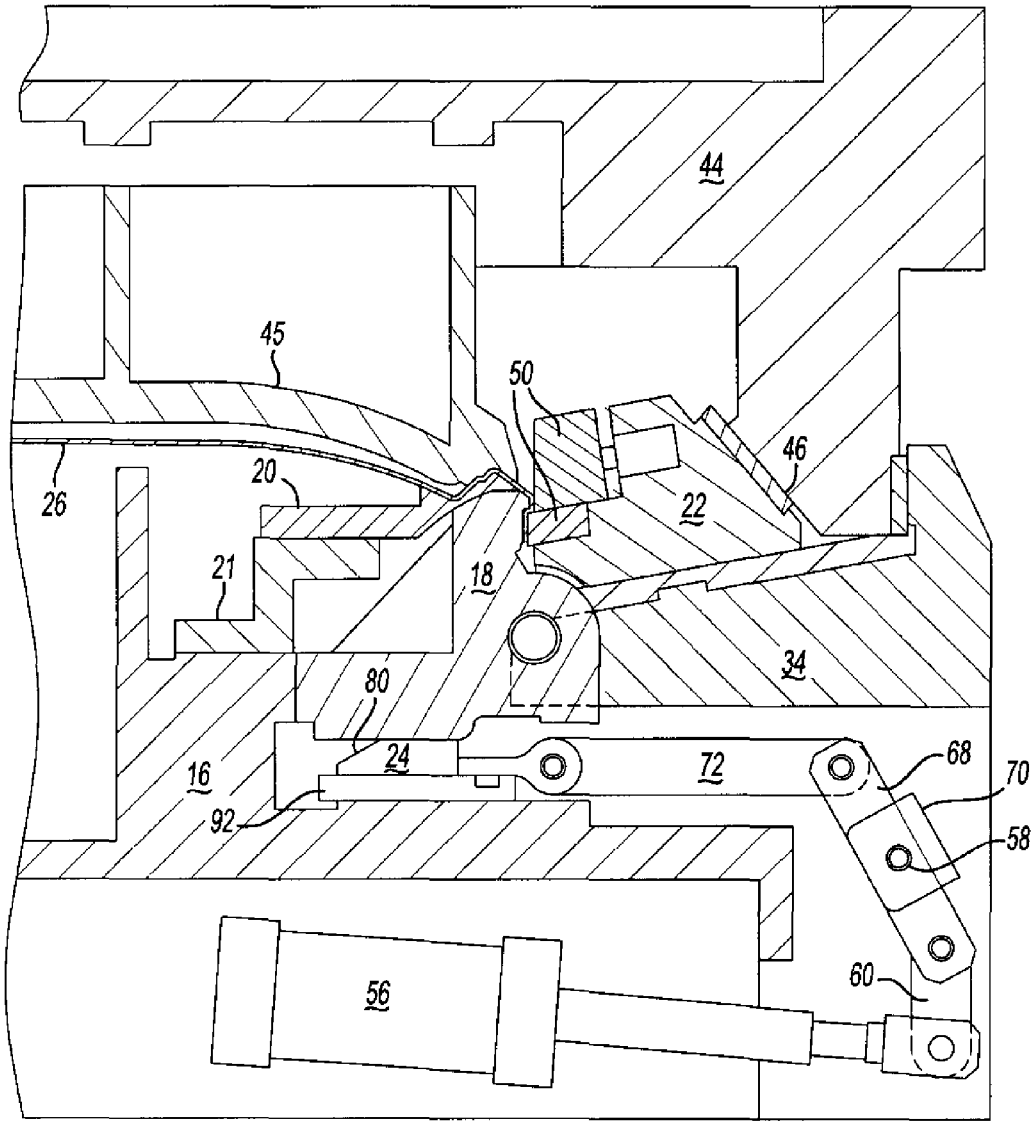

The rotating filler cams 18 may have any shape desired to one skilled in the art. In this regard, the rotating filler cams 18 are generally used as an anvil that assists in forming or flanging a metal substrate or panel 26 that will, subsequently, form a structure for an automobile. For example, as best shown in FIGS. 5A and 5B, the rotating filler cam 18 has a mold surface 28 that will transfer its shape to an edge of the metal substrate 26 that will be used to form a body panel, hood, or door for an automobile. Since these structures are continually changing as aesthetically, aerodynamically, and structurally required, the mold surface 28 of the rotating filler cams 18 may have a shape different than that illustrated in the drawings.

With respect to the construction of rotating filler cam 18, any material sufficient in forming or flanging the metal substrate 26 is contemplated. Preferably, hardened alloy steels are preferred, but it is not out of the scope of the present teachings to use a rotating filler cam 18 formed of some other suitable material with a sufficient hardness and mass that can withstand forming and flanging metal substrates such as steel.

Caps 20*a*, 20*b*, and 20*c* (hereinafter "caps 20") are stationary members that are mounted to an adapter 21, which is mounted to lower die 16. Caps 20 provide an additional mold surface 30 (FIG. 4) that assists in forming or flanging the metal substrate 26. Surface 30 also acts as a support structure for portions of the metal substrate 26 that are not being formed or flanged. Similar to the filler cam 18, the cap 20 may be formed of a hardened alloy steel, or the like.

Forming cam 22 is generally disposed over wedge actuation assembly 14 and is held and supported by a forming cam adapter 34 that is mounted to the lower die 16. The forming cam 22 is mounted to the forming cam adapter 34 by way of connection mechanisms 36. The forming cam 22 is slidably actuatable as shown in FIGS. 5A and 5B, and is held in a non-engagement position (i.e., a position where the forming cam is not being used to form or flange the metal substrate 26) by a tension device 40. As illustrated in the drawings, the tension device 40 may be an air cylinder, a hydraulic cylinder, or a nitrogen cylinder. It should be understood, however, that the tension device 40 applies a constant force to the forming cam 22 to keep the forming cam 22 in the non-engagement position. Accordingly, any device, such as a spring, that is suitable for applying a constant tension force may be used without departing from the spirit and scope of the present teachings.

Form cam 22 also includes angled surfaces 42. These surfaces 42 provide a bearing surface for an upper die 44 (see FIGS. 5A and 5B) that includes a corresponding and opposing surface 46. That is, when a metal substrate 26 is to be formed or flanged, the upper die 44 will be lowered such that the corresponding surface 46 of the upper die 44 contacts the form cam 22. The relationship between the upper die 44 and the form cam 22 will be described in more detail when operation of the rotating filler cam system 10 is described. To remove the forming cam 22, the forming cam 22 includes lift plates 48 that, when removed, expose a hook or eyelet (not shown) that enables a device such as a crane to lift the forming cam 22 from the rotating filler cam system 10. This construction enables repair and maintenance of the forming cam 22.

Although the forming cam 22 has been described above as being mounted to the lower die 16, aerial form cams may be used instead. That is, the forming cam 22 can be mounted to the upper die 44 without departing from the spirit and scope of the present teachings. Regardless, it is preferable that the forming cam 20 is mounted to the lower die 16. Mounting the forming cam 22 to the lower die 16 enables easier maintenance of the forming cam 22.

The forming cam 22 further includes a plurality of removable spacers or forming steels 50 that are disposed on ledge 52 of the forming cam 22. Spacers 50 provide an opposing surface 54 that corresponds to the shape and contour of the filler cam 18 and cap 20. As such, upon actuation of the rotating filler cam 18, the substrate 22 will be pressed between the rotating filler cam 18 and the forming cam 22 and caused to have a shape or flange that corresponds to the shape and contours of both the rotating filler cam 18 and the spacers 50 of the forming cam 22. It goes without saying, therefore, that the spacers 50 of the form cam 22 may also be formed to have any shape desired, Moreover, forming cam 22, like rotating filler cam 18, can be formed of any material sufficient at forming or flanging a metal substrate. Again, materials include hardened alloy steels and the like.

Figure 1:
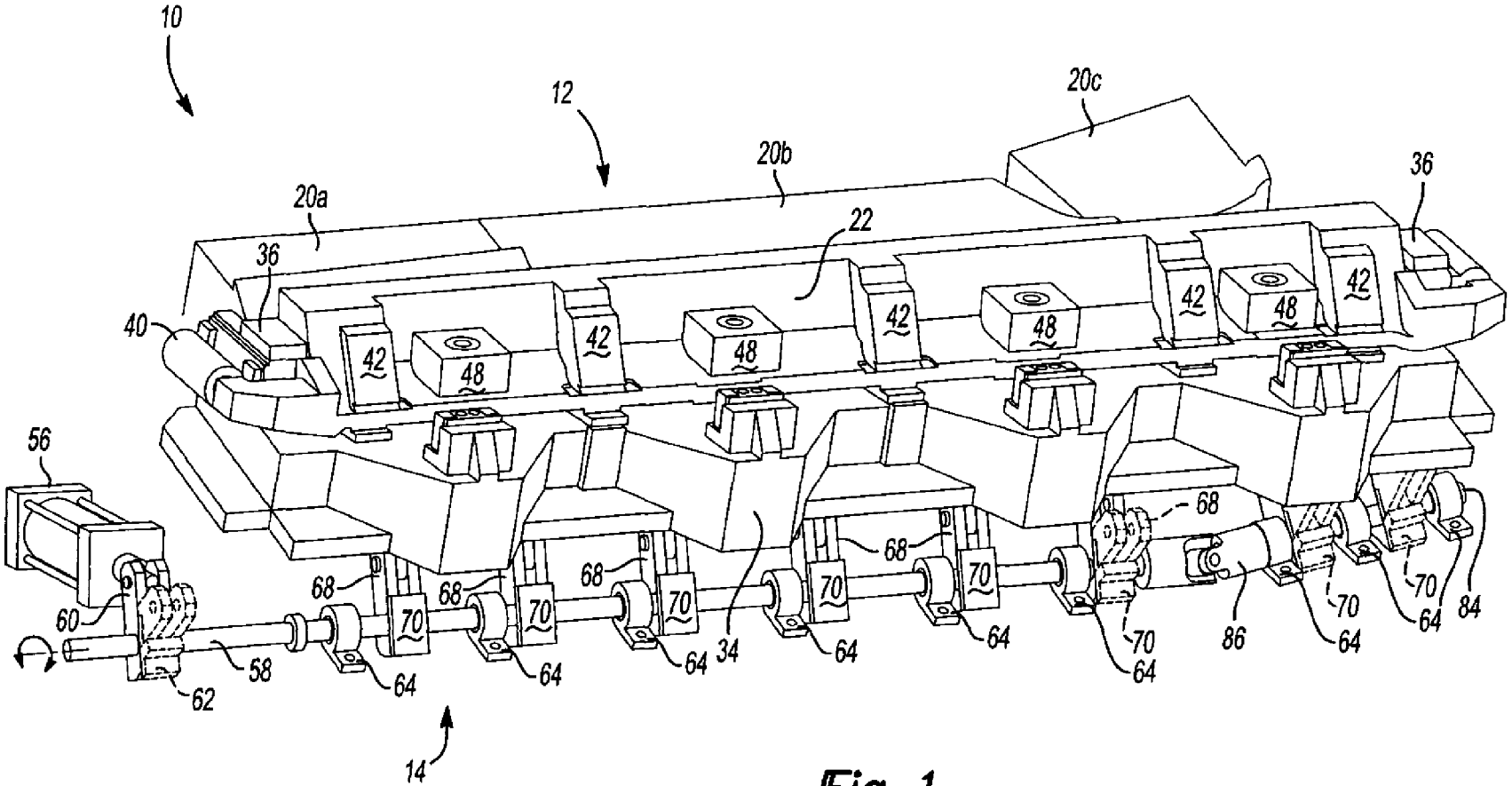
FIG. 1 is a perspective view of the rotating filler cam system according to the present teachings.
Figure 2:
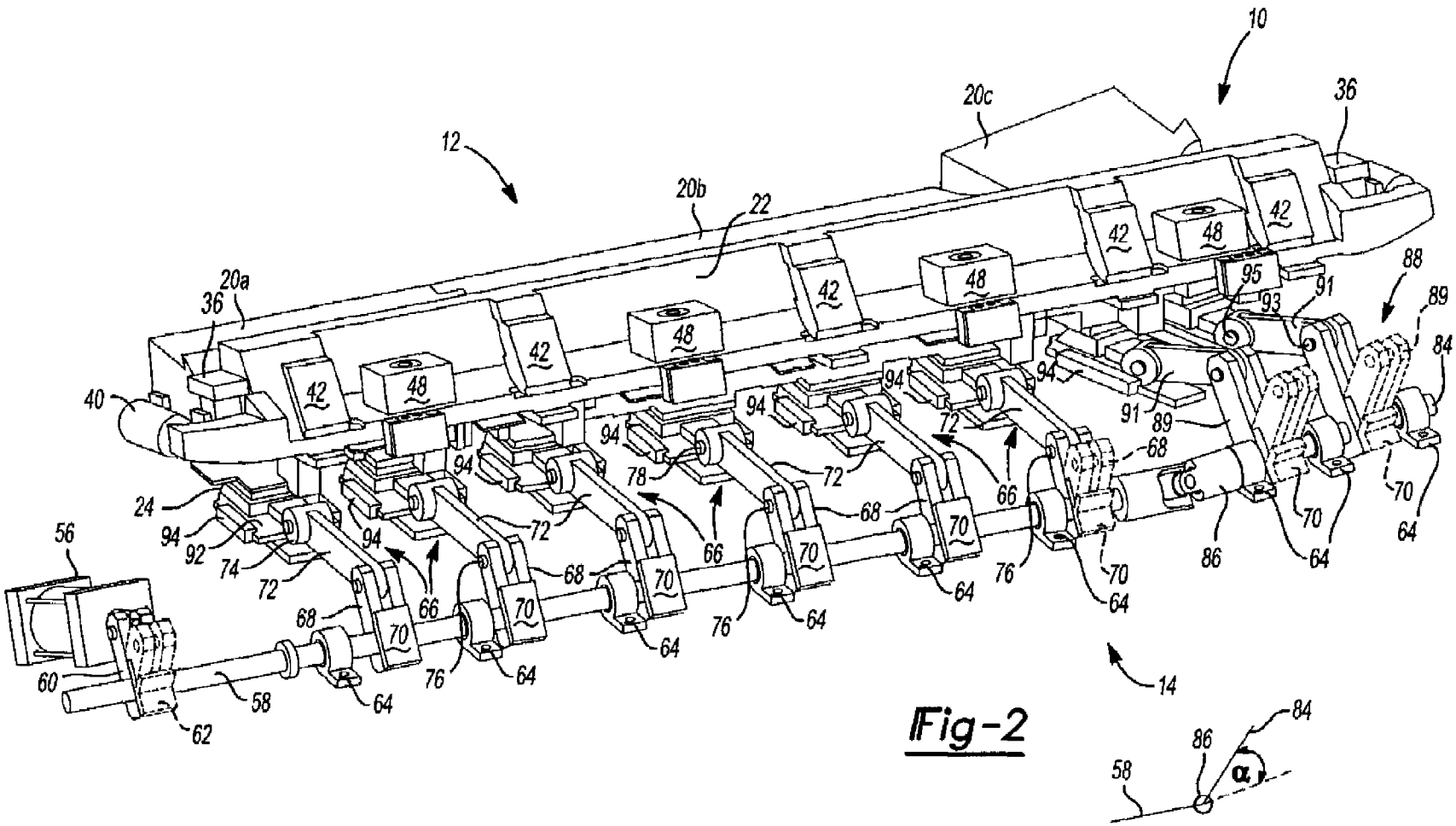
FIG. 2 is another perspective view of the rotating filler cam system according to the present teachings.
Figure 3:
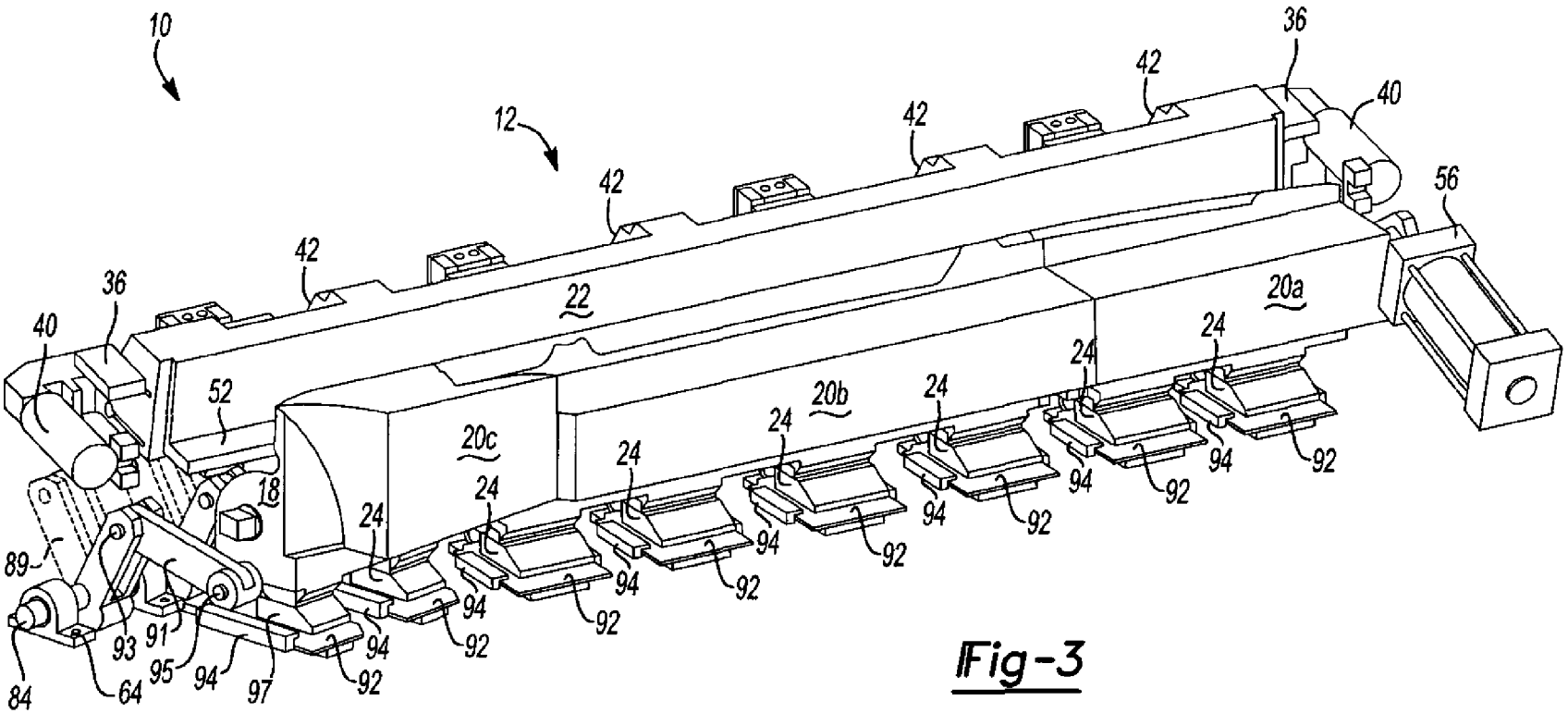
FIG. 3 is a perspective view of the wedge actuation assembly of the rotating filler cam system according to the present teachings.
Figure 4:
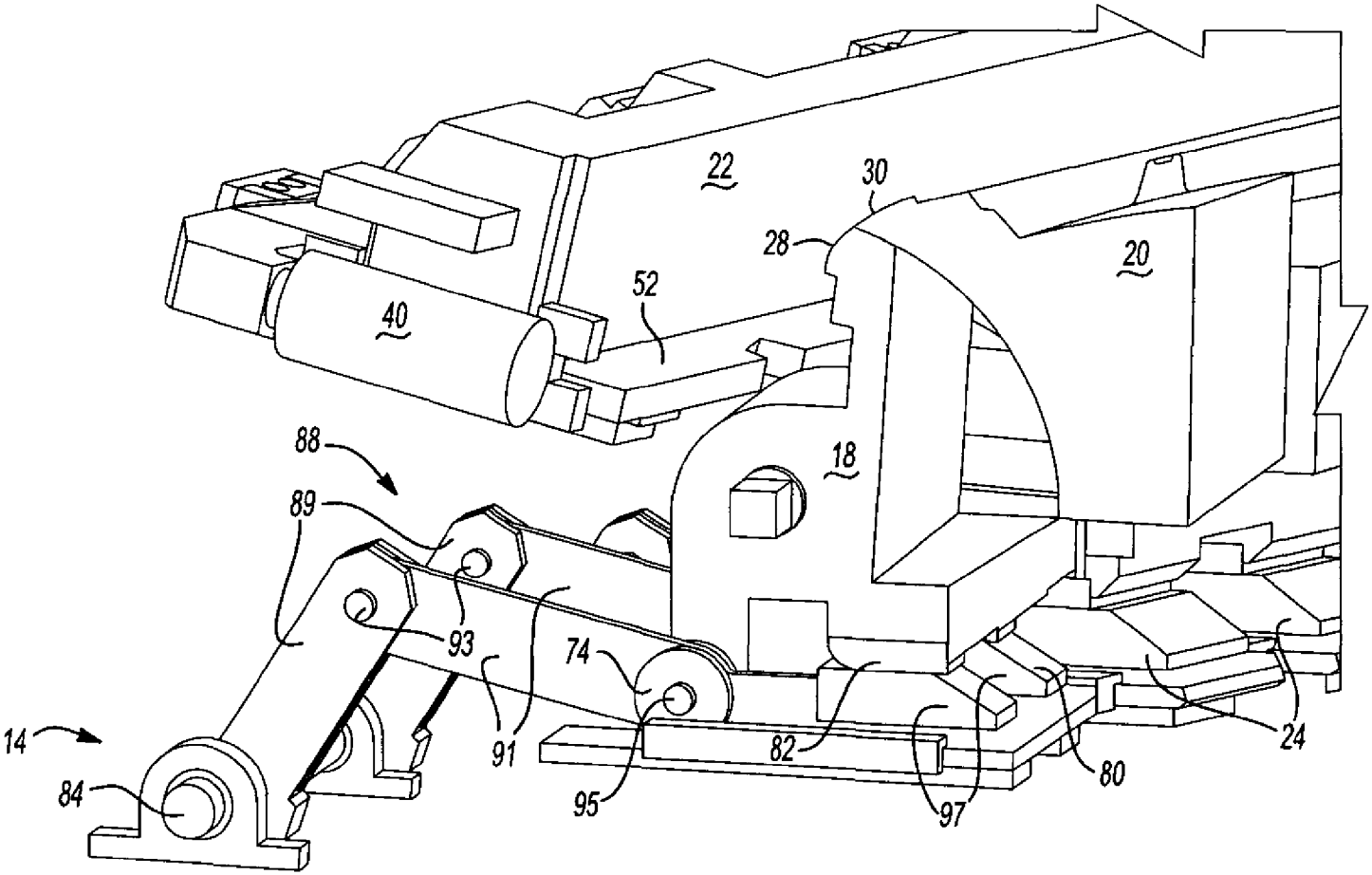
FIG. 4 is a close-up perspective view of the wedge actuation assembly of the rotating filler cam system according to the present teachings.

Now referring more particularly to FIGS. 1 to 4, the wedge actuation assembly 14 will now be described in more detail. As best illustrated in FIGS. 1-3, the wedge actuation assembly 14 includes a drive mechanism 56 that is coupled to a drive shaft 58. Drive mechanism 56 is mounted to the lower die 16 (FIGS. 5A and 5B), and may be any device known to one of ordinary skill in the art that is sufficient in rotating drive shaft 58. Preferably, drive mechanism 56 is a pneumatic device such as an air cylinder. Notwithstanding, drive mechanism 56 may be a hydraulic device, an electric motor, etc.

Drive mechanism 56 is coupled to the drive shaft 58 by a rotating arm 60. When drive mechanism is actuated or fired, the rotating arm 60 is forced to rotate. Since rotating arm 60 is fixedly secured to drive shaft 58, drive shaft 58 is also rotated. As the drive mechanism is activated between its firing and non-firing state, the rotating arm 60 is rotated toward and away from the drive mechanism 56, which in turn causes the drive shaft 58 to rotate toward and away from the drive mechanism 56. In this manner, the drive shaft 56 may be rotated back and forth.

In the illustrated configuration, rotating arm 60 is fixedly secured to drive shaft 58 by a locking plate 62. By securing the rotating arm 60 to the drive shaft 58 in this manner, rotating arm 60, and drive shaft 58 may be repaired or replaced, as needed. It should be understood, however, that rotating arm 60 may be secured to the drive shaft 58 in any manner known in the art. For example, the rotating arm 60 may be secured to the drive shaft 58 by welding or the like.

The drive shaft 58 is a generally cylindrical shaft that is supported by support bearings 64. As the drive shaft 58 rotates back and forth, a plurality of wedge assemblies 66 are driven back and forth to engage and rotate filler cams 18. That is, also fixedly secured to the drive shaft 58 to rotate therewith, are a plurality of wedge assemblies 66. Each wedge assembly 66 includes an actuation arm or device 68. Actuation arms 68 are similar to the rotating arm 60 and are secured to the drive shaft 58 in the same manner. That is, actuation arms 68 are secured to the drive shaft 58 by locking plates 70. Again, however, it should be noted that actuation arms 68 may be secured to the drive shaft 58 in any manner desired, such as by welding or the like.

Hingedly coupled to actuation arms 68 are drive arms 72, which in turn drive a wedge 24 to contact the rotating filler cam 18. The drive arms 72 drive the wedges 24 in a back and forth motion. At an end 74 of the drive arms 72 that is opposite the end that includes the hinged connection 76 between the actuation arm 68 and the drive arm 72 are the wedges 24. Wedges 24 are connected to the drive arms 72 by a hinge 78 that allows the wedge 24 to move back and forth in a linear manner.

Wedges 24 are generally rectangular in shape, and include an angled surface 80 that engages the rotating filler cam 18. To protect the rotating filler cam 18 from the frictional forces experienced when wedges 24 engage filler cam 18, the filler cam 18 includes a slide pad 82. Slide pads 82 and wedges 24 are replaceable units so that during operation of the rotating filler cam system 10, these units can be removed and replaced as needed. Accordingly, the useful life of the rotating filler cam system 10 can be lengthened.

To form or flange the curved panels used in automobiles, the drive shaft 58 of the rotating filler cam system 10 of the present teachings may be connected to another drive shaft 84 by a U-joint 86. U-joint 86 may be any type of U-joint known to one skilled in the art. Through use of U-joint 86, drive shaft 84 may be rotated in the same manner as drive shaft 58. That is, as drive mechanism 56 is actuated, drive shaft 58 will rotated back and forth as described above. Because drive shaft 58 is connected to the drive shaft 54 by the U-joint 56, the drive shaft 84 will also rotate back and forth.

Connected to drive shaft 84 is another plurality of wedge assemblies 88. Wedge assemblies 88 include the same elements as wedge assemblies 66. That is, wedge assemblies 88 each include an actuation arm 89, a drive arm 91, hinges 93 and 95, and a wedge 97. Actuation arms 89 are secured to drive shaft 88 by locking plates 70. Wedge assemblies 88, however, differ from the wedge assemblies 66 in that the actuation arms 89 and drive arms 91 have different lengths compared to actuation arms 68 and drive arms 72.

The different lengths of the actuation arms 89 and drive arms 91 is to account for the angle $\alpha$ that the drive shaft 84 is offset from drive shaft 58. Drive shaft 84 is offset from drive shaft 58 by angle $\alpha$ to account for a curvature of the panel to be formed or flanged. Notwithstanding, drive shaft 84 may not be able to be precisely aligned with the curvature of the panel to be formed or flanged. Regardless, the rotating filler cams 18 must be actuated with precise timing during the forming or flanging process. Accordingly, to precisely time the engagement of wedge assemblies 66 and 88, the lengths of the actuation arm 68 and 89 and drive arms 72 and 91, respectively, are different to account for the imprecise alignability of the drive shaft 84 with the curvature of the panel. In this regard, actuation arms 89 generally have a greater length than actuation arms 68 to account for a greater distance that wedge assemblies 88 have to travel to engage filler cams 18. In contrast, a length of drive arms 91 is generally less than or equal to a length of drive arms 72.

More particularly, operation of the rotating filler cam system 10 will now be described with reference to FIGS. 5A and 5B. FIG. 5A illustrates a state of the rotating filler cam system 10 when the wedges 24 are not engaged with the rotating filler cam 18. In other words, in a state when the drive mechanism 56 has not been fired.

When the drive mechanism 56 is fired, the drive shafts 58 and 84 are rotated in a direction toward the rotating filler cam 18. As the drive shafts, 58 and 84 rotate in this direction, the actuation arms 68 are also rotated in the direction toward the rotating filler cam 18. The rotation of actuation arms 68 pushes drive arms 72 and wedges 24 toward rotating filler cam 18 such that wedges 24 engage the rotating filler cam 18.

As illustrated in FIG. 5B, as wedges 24 engage rotating filler cam 18, the rotating filler cam 18 is forced up the angled surface 80 of wedges 24, and wedges 24 will slide beneath the rotating filler cam 18. Rotating filler cam 18 will subsequently be forced to rotate about pivot point 90 to a forming or flanging position. When rotating filler cam 18 is in the forming or flanging position, the substrate 26 to be formed or flanged will be compressed between filler cam 18 and forming cam 22. The rotating filler cam 18 is left in this position for a predetermined and sufficient amount of time to form or flange the substrate 26.

To provide a bearing surface for wedges 24, a slide plate 92 is used. In addition to providing a bearing surface for wedges 24, slide plate 92 also acts as a support surface for wedges 24. Further, to ensure that wedges 24 engage rotating filler cam 18 in a manner that is essentially normal to filler cam 18, guide rails 94 are disposed at edges of the slide plates 92 to ensure proper tracking of the wedges 24.

After the substrate 26 has been formed or flanged, the drive mechanism 56 is retreats to an un-fired state which causes the drive shafts 58 and 84 and to rotate back away from rotating filler cam 18. As the drive shafts 58 and 84 and rotate back away from rotating filler cam 18, the rotating filler cam 18, wedges 24, drive arms 72, and actuation arms 68 will return to the state shown in FIG. 5A.

With respect to rotation of the drive shafts 58 and 84, it should be understood that the drive shaft 58 rotates the same amount or distance as drive shaft 84. To account for the angle $\alpha$ that drive shaft 84 is offset from drive shaft 58, as stated above, the lengths and of actuation arms 89 and drive arms 91 are different. Notwithstanding, the lengths are predetermined such that although the timing of wedges 24 and 97 initially engaging filler cams 18 are different, the filler cams 18 are actuated to be in a forming or flanging position at the same time. In this manner, panels of various shapes and sizes can be formed or flanged without removing the substrate 26 from the rotating filler cam system 10.

To determine the proper timing of the actuation arms 89 and drive arms 91, the distance that the U-joint wedges 97 have to travel to engage the filler cam 18 relative to the distance that the wedges 24 have to travel to engage the filler cam 18 is taken into consideration. That is, as stated above, the U-joint wedges 97 have to travel a greater distance than wedges 24 due to the angle at which drive shaft 84 can be angled relative to drive shaft 58. This greater distance, known as dwell, must be taken into consideration so that the rotating filler cams 18 actuated by the wedges 24 and 97 can rotate into position to form or flange the steel substrate 26 at or about the same, or at least at substantially the same time.

Figure 6:
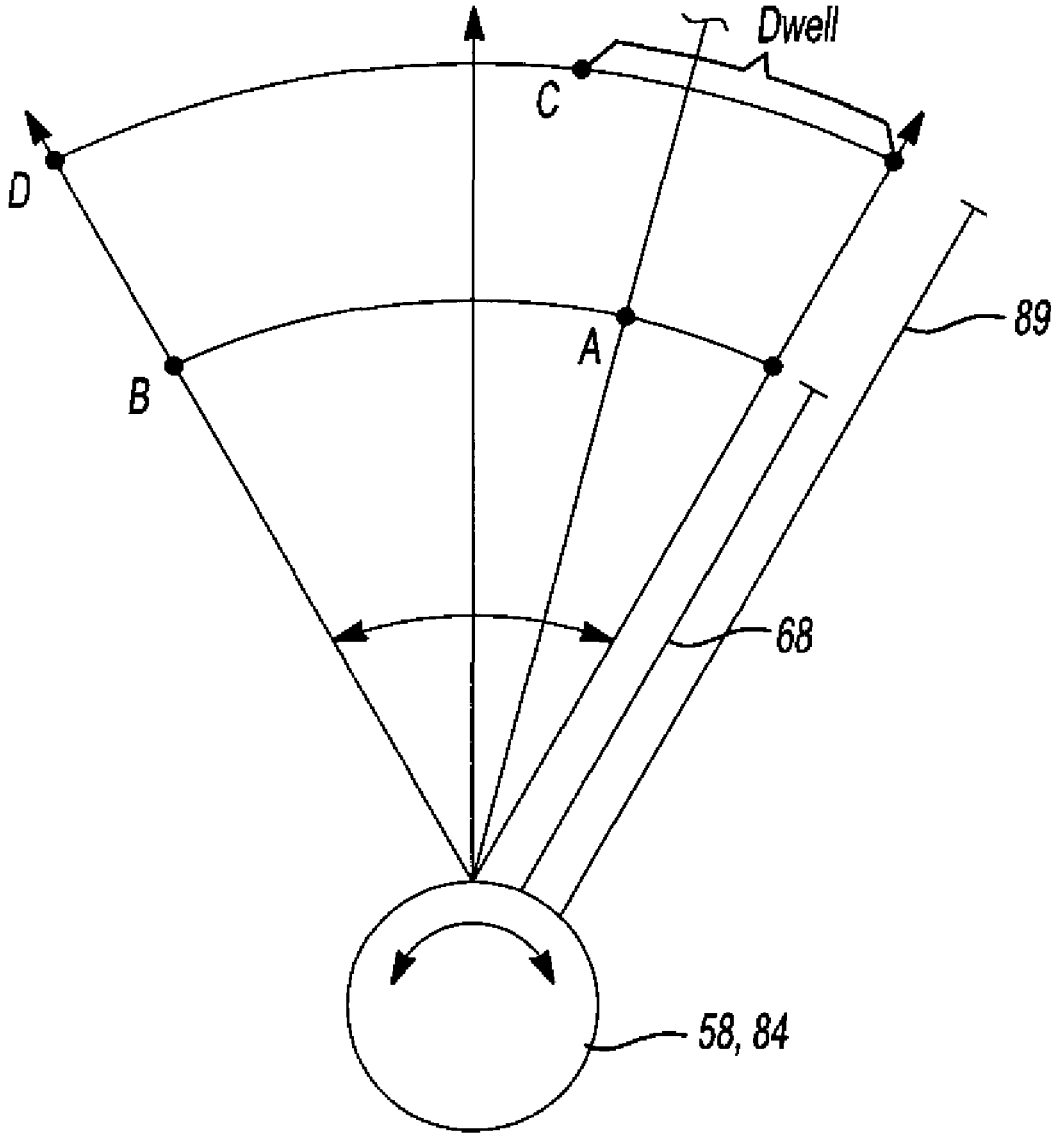
FIG. 6 is schematic view depicting how timing of the wedge assemblies is mechanically determined.

Referring to FIG. 6, the timing associated with actuation arms 68 and 89 can be calculated mechanically. In FIG. 6, the distance traveled by actuation arms 68 and 89 relative to each other and the drive shaft 58 and 84 is shown in cross-section. An initial position (i.e., a position prior to firing of drive mechanism 56) of actuation arms 68 and 89 is offset from a line normal to drive shafts 58 and 84 by 30°. The final position (i.e., a position after firing of drive mechanism 56) of actuation arms 68 and 89 is also offset from the line normal to the drive shaft by 30°.

As drive shafts 58 and 84 rotate, actuation arm 68 will force wedges 24 to initially contact their corresponding rotating filler cams 18. During this initial contact (shown at point "A"), the rotating filler cam 18 will gradually begin to rotate to a first position, or "cam up" position. As the rotating filler cam 18 begins to enter the cam up position, actuation arms 89 and their corresponding wedges 97 are traveling through the dwell to initially contact its corresponding rotating filler cam 18 (shown at point "C"). As wedges 24 begin to more fully slide under cam 18 and force cam 18 to rotate into a second position (i.e., a forming or flanging position; shown at point "B"), wedges 97 will contact its corresponding cam 18 and force cam 18 to enter its cam up position C. Subsequently, the rotating filler cam 18 will be fully rotated to its forming or flanging position (shown at point "D") at the same time.

It should be understood that the distances traveled by actuation arms 68 and 89 from the cam up positions A and C to the form or flange positions B and D are equal. That is, the distance traveled by actuation arm 68 shown in FIG. 6 to be line AB is equal the distance traveled by actuation arm 89 shown in FIG. 6 to be line CD. The distance that actuation arm 89 has to make up is the dwell. This is the distance at which wedges 97 need to be disposed relative to rotating filler cam 18 to ensure that timing of each of the filler cams 18 is the same when the wedges 24 rotate their corresponding filler cams 18 to the forming or flanging position. Since the proper timing and dwell can be determined in this manner, the timing of the wedge assemblies 66 and 88 of the rotating filler cam system 10 may adjusted mechanically. Mechanically adjusting the timing of the filler cam system 10 in this manner eliminates the synchronizing of multiple filler cams that are actuated by multiple drive units. This reduces the overall cost of the system, as well as reduces the overall maintenance of the system.

Again referring to FIGS. 5A and 5B, movement of the form cam 22 along with the rotating filler cam 18 will now be described. As the rotating filler cams 18 are actuated by wedge actuation assemblies 14, the upper die 44 begins to lower. As stated earlier, the upper die 44 includes a wedge-shaped surface 46 or surfaces that correspond to the angled surfaces 42 formed on the form cam 22. Upper die 44 may also include a pad 45 that assists in supporting and forming the substrate 26.

As the die 44 is lowered, the wedge-shaped surface(s) 46 will contact and slide along the angled surfaces 42 of the form cam 22. Due to the high mass of the upper die 44, the force exerted on the forming cam 22 by the upper die 44 will be enough to overcome the tensional force exerted on the forming cam 22 by the tension device 40. The forming cam 22, therefore, will be forced to slide along the rails toward the filler cam 18. When a metal substrate 26 is disposed between the forming cam 22 and the filler cam 18, the mass of the form cam 22 and upper die 44 will form or flange the substrate 26.

After the substrate 26 has had sufficient time to be formed or flanged, the upper die 44 will be raised and the tension device 40 will pull the form cam 22 away from the rotating filler cam 18. Simultaneously, or at least shortly thereafter, the drive mechanism 56 will rotate the drive shafts 58 and 84 away from the rotating filler cam 18 to disengage the wedges 24 and 97 from the rotating filler cams 18. Accordingly, the rotating filler cam 18 will rotate back towards its resting position. The formed or flanged substrate 26 may then be removed from system 10.

It should be understood that actuation of the form cam 22 and filler cams 18 enables easy removal of the substrate 26 after it has been formed or flanged. That is, the constant tensional force applied to the form cam 22 by tension device 40 enables the form cam 22 to be pulled way from the filler cam 18 after forming or flanging the substrate 26. Further, rotation of the filler cam 18 unlocks the filler cam 18 from the formed or flanged substrate 26. That is, as stated above, the filler cam 18 has a shape that corresponds to the desired shape or flange that will be imparted to the substrate 26. If the filler cam 18 did not rotate downward towards the lower die 16 after forming or flanging, the substrate 26 may become "locked" to the filler cam 18. The "locking" of the substrate 26 to the filler cam 18 would require additional manufacture time to remove the substrate 26 from the filler cam 18, which in turn increases manufacturing costs and time. The present teachings, however, avoid these unnecessary costs and time constraints.

It should be understood that although only a pair of drive shafts 58 and 84 and connected by U-joint 86 are shown in the figures, the present teachings should not be limited thereto. Rather, a plurality of drive shafts each including a plurality of wedge assemblies can be connected by a series of U-joints. As such, the rotating filler cam 10 system can be adapted to form or flange any size or shape substrate 26. For example, a unitary substrate can be used to form a door or side body panel. In this regard, the form or flange desired for the panel, even at corners, can be formed using a series of drive shafts connected by U-joints.

Further, it should be understood that by using a U-joint 86 to connect adjacent drive shafts 58 and 84, only a single drive mechanism 56 is needed to activate multiple filler cams 18. The use of a single drive mechanism 56 lowers the overall cost and maintenance associated with the rotating filler cam system 10. Notwithstanding, multiple drive mechanisms may also be utilized.

Figure 7:
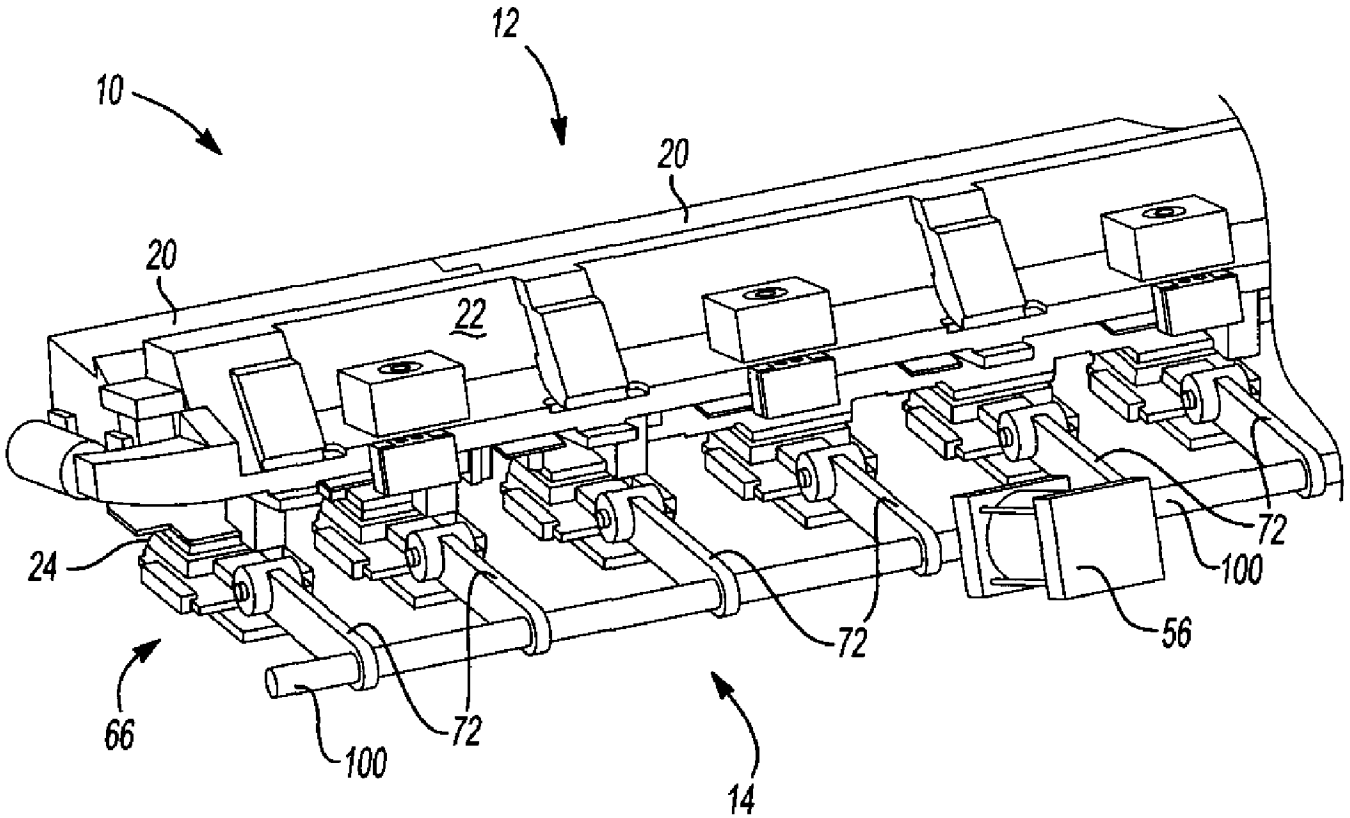
FIG. 7 is a perspective view of another rotating filler cam system according to the present teachings.

Moreover, the present teachings should not be limited to the wedge actuation assemblies 14 described above. That is, instead of using a drive mechanism 56 to rotate shafts 58 and 84 to actuate wedge assemblies 66 and 88, a drive mechanism 56 that directly drives the wedges assemblies 66 may be used. In this regard, referring to FIG. 7, the wedges 24 may be connected via drive arms 72 to a frame 100 that is driven back and forth by the drive mechanism 56 to eliminate use of the rotating shafts. This configuration eliminates the drive shaft 58 and actuation arms 68, which further reduces manufacturing costs and maintenance. It should be understood that although a plurality of wedges are shown in each of the above-described configurations, only a single wedge is required.

Figure 8:
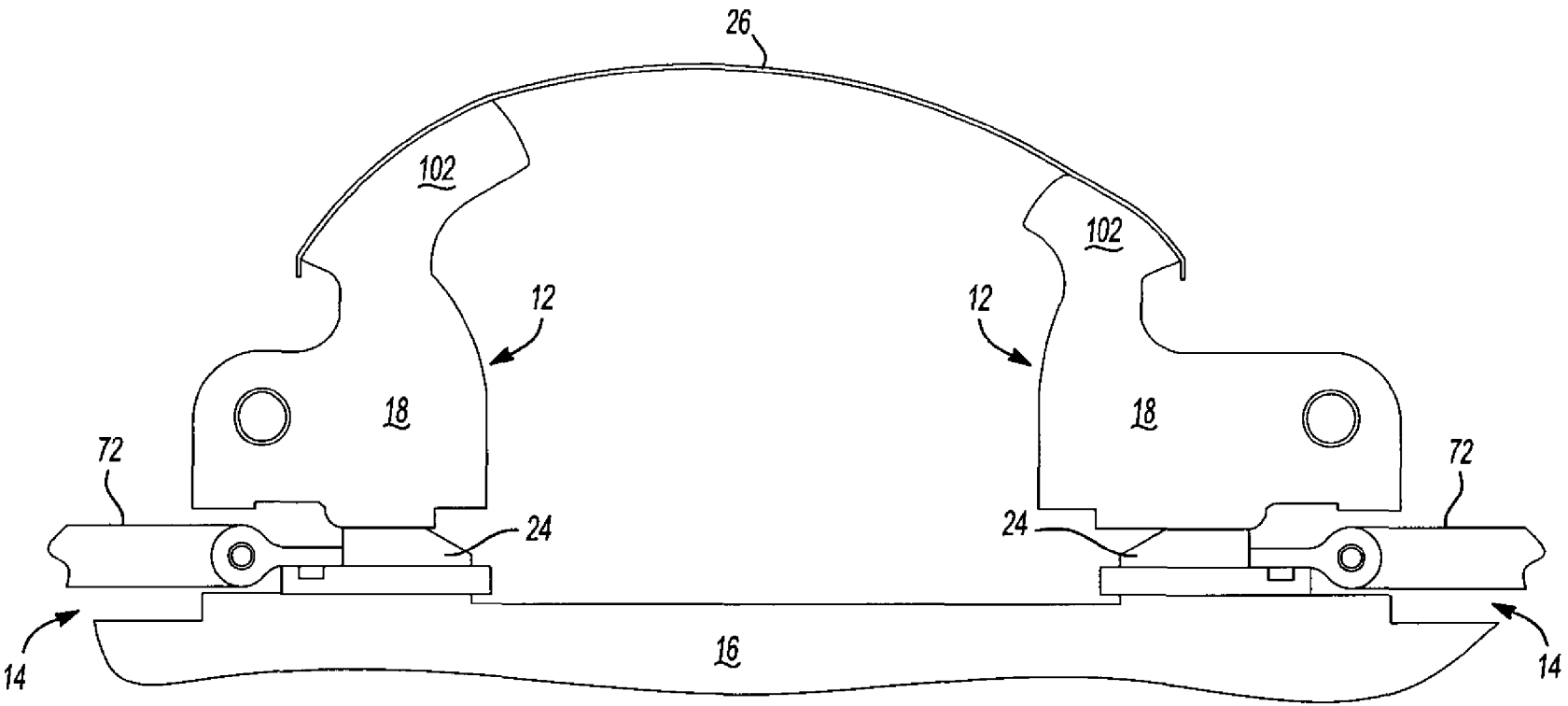
FIG. 8 is a side-perspective view of another rotating filler cam system according to the present teachings.

Now referring to FIG. 8, another configuration of the present teachings will be described. In FIG. 8, a pair of cam assemblies 12 and wedge actuation assemblies 14 are illustrated. The corresponding forming cams are omitted for clarity of illustration, The components and operation of each of the cam assemblies 12 and wedge actuation assemblies 14 are substantially the same as the configurations described above. The rotating filler cams 18, however, have been modified to eliminate the stationary caps 20 that are used to support the substrate 26 to be formed or flanged.

To eliminate the use of the stationary caps 20, the caps are integrated into the rotating filler cams 18. That is, each rotating filler cam 18 includes an extended portion 102 that replaces the stationary caps 20. Accordingly, the rotating filler cams 18 are adapted to both form and flange the substrate 26, as well as support the substrate 26 during the forming or flanging process. In this manner, the cost of manufacturing the rotating filler cam system 10 can be reduced. Further, overall maintenance of the rotating filler cam system 10 can also be reduced as fewer components are used in the system 10. Still further, although not shown in FIG. 8, it should be noted that each wedge actuation assembly 14 may be actuated by a single drive mechanism that is coupled to each assembly 14. This also reduces the manufacturing cost of the system 10.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A cam system comprising:

at least one filler cam;

at least one wedge assembly connected to a rotatable drive shaft, said wedge assembly including an actuation arm fixed to said drive shaft, a drive arm hingedly coupled to said actuation arm, and a wedge connected to said drive arm; and a drive mechanism for rotating said drive shaft, wherein upon rotation of said drive shaft, said wedge assembly engages said filler cam to rotate said filler cam from a first position to a second position.

2. The cam system of claim 1, further comprising a second rotatable drive shaft including a second wedge assembly, said second wedge assembly also including a second actuation arm fixed to said second drive shaft, a second drive arm hingedly coupled to said second actuation arm, and a second wedge connected to said second drive arm, said second drive shaft connected to said drive shaft by a U-joint.

3. The cam system of claim 2, wherein said second actuation arm of said second wedge assembly has a length that is greater than a length of said actuation arm of said wedge assembly.

4. The cam system of claim 1, wherein said drive mechanism is an air cylinder or a hydraulic cylinder.

5. The cam system of claim 1, further comprising a form cam.

6. The cam system of claim 1, further comprising at least one cap adjacent said wedge assembly.

7. The cam system of claim 6, wherein said cap and said filler cam are integral.

8. A rotating filler cam system comprising:

a lower die;

a plurality of filler cams mounted to said lower die;

a first group of wedge assemblies connected to a drive shaft, each of said wedge assemblies of said first group including an actuation arm fixed to said drive shaft, a drive arm hingedly coupled to said actuation arm, and a wedge connected to said drive arm;

a drive mechanism for rotating said drive shaft; and a forming cam, wherein upon rotation of said drive shaft, said first group of wedge assemblies engage said filler cams to rotate said filler cams from a first position to a second position.

9. The rotating filler cam system of claim 8, further comprising a 8econd group of wedge assemblies connected to a second drive shaft, each of said wedge assemblies of said second group including a second actuation arm fixed to said second drive shaft, a second drive arm hingedly coupled to said second actuation arm, and a second wedge connected to said second drive arm, said second drive shaft connected to said drive shaft by a U-joint.

10. The rotating filler cam system of claim 9, wherein said drive mechanism rotates said second drive shaft, and upon rotation of said second drive shaft, said second group of wedge assemblies engage said filler cams to rotate said filler cams from said first position to said second position.

11. The rotating filler cam system of claim 10, wherein said first group of wedge assemblies and said second group of wedge assemblies rotate said filler cams to said second position at the same time.

12. The rotating filler cam system of claim 8, wherein said forming cam is mounted to said lower die.

13. The rotating filler cam system of claim 8, further comprising an upper die.

14. The rotating filler cam system of claim 13, wherein said upper die actuates said forming cam.

15. The rotating filler cam system of claim 8, further comprising a plurality of caps mounted to said lower die.

16. A rotating filler cam system comprising:

an lower die and an upper die;

a plurality of filler cams rotatably connected to said lower die;

a plurality of first wedge assemblies connected to a first drive shaft and a plurality of second wedge assemblies connected to a second drive shaft, said second drive shaft connected to said first drive shaft, each wedge assembly including a wedge, a drive arm connected said wedge, and an actuation arm hingedly connected to said drive arm and fixed to said drive shaft, said actuation arms of said second wedge assemblies being longer than said actuation arms of said first wedge assemblies;

a drive mechanism for actuating said drive shafts; and a forming cam attached to either said lower die or said upper die, wherein upon actuation of said drive shaft, said wedge assemblies are driven by said drive arms and said actuation arms to contact said filler cams and rotate said filler cams from a first to a second position.

* * * * *